United States Patent [19]

Bue et al.

[11] 4,136,622

[45] Jan. 30, 1979

[54] FOLDING WALL TABLE

[75] Inventors: Richard C. Bue, Chaska; Casey L. Carlson, Minneapolis, both of Minn.

[73] Assignee: Sico Incorporated, Minneapolis, Minn.

[21] Appl. No.: 793,599

[22] Filed: May 4, 1977

Related U.S. Application Data

[63] Continuation-in-part of Ser. No. 760,851, Jan. 21, 1977, Pat. No. 4,100,858.

[51] Int. Cl.[2] ..... A47B 5/00

[52] U.S. Cl. ..... 108/48; 108/115; 312/314

[58] Field of Search ..... 108/48, 35, 115, 130, 108/152, 39, 111; 248/240.1, 240.2, 240.4; 312/313, 314, 315

[56] References Cited

U.S. PATENT DOCUMENTS

| | | | |
|---|---|---|---|
| 2,636,549 | 4/1953 | Geller | 108/48 X |
| 2,692,812 | 10/1954 | Stahl | 108/39 X |
| 2,916,339 | 12/1959 | Zobac | 108/39 X |
| 3,088,127 | 5/1963 | Eames | 108/48 X |
| 3,522,970 | 8/1970 | Francis | 248/240.4 X |
| 3,696,762 | 10/1972 | Holdham | 108/48 |
| 3,730,107 | 5/1973 | Bergkamp et al. | 108/39 |

*Primary Examiner*—James T. McCall
*Attorney, Agent, or Firm*—Merchant, Gould, Smith, Edell, Welter & Schmidt

[57] ABSTRACT

A table surface member is movable between a vertical storage position against a wall and a usable positioned horizontally extending from the wall. The table member connects to the wall by means of a hinge assembly which permits folding of the table such that the upper edge of the table in the storage position is the edge adjacent the wall in the usable position. In a preferred embodiment latch means are provided for latching the edge of the table to the wall or wall mounting bracket in the usuable position, so that no supporting legs for the outer end of the table are required. Alternatively, another disclosed embodiment uses folding legs to support the outer edge of the table in the usuable position. A preferred hinge assembly includes upper and lower hinge arms pivotally connecting to the wall and the table. The pivotal axis of the lower arm or arms to the table is spaced below a plane passing through the pivot axis of the upper arm to the table and parallel with the table surface. This offset plus intentional length mismatching of the hinge arms provides an overcenter resistance force which holds the table in its storage position without the need for a separate latch or counterbalance.

10 Claims, 19 Drawing Figures

14
15
16
110
113
114
115
116
118
119
120
121
122
123
124
126
127
130
131
131a
131b
132
133
134
135
136
140
141
142
143
144
145
150a
150b
151
152
153
154
155a
155b
156
160a
160b
161
162
164
166a
166b
170
171
172
190

FOLDING WALL TABLE

BACKGROUND OF THE INVENTION

This patent application is a continuation-in-part of our earlier application Ser. No. 760,851, filed Jan. 21, 1977.

The present invention pertains to the field of folding wall tables of the type designed to fold between a storage position in which the table is vertically positioned adjacent the wall, and a usable position in which the table extends horizontally from the wall.

One such prior art type of folding table is shown in U.S. Pat. No. 3,866,547, issued to Guyton. In this patent, the end of the table nearest the wall is connected thereto and supported by hinge arms, while the outer end is supported by auxiliary fold-up legs. During folding to the storage position, the outer end of the table rolls along the floor on follers which are provided in the table end. A disadvantage of this type of structure is the requirement of the roller wheels along the table end. Roller wheels eventually become covered with grease leaking from around the axle, and dirt or dust picked up from the floor. It is of course not desirable to have grease or dirt near the table work surface, and particularly directly in front of a person who might sit at the end of the table. Another disadvantage of this type of structure is the requirement of a separate latch to hold the table in its vertical storage position. The separate latch adds another part to the cost of the table and adds another step which must be performed in the operation of the table.

Another type of prior art folding table is shown in U.S. Pat. No. 3,730,107 issued to Bergkamp et al. In this patent, the table or ironing board folds to the vertical storage position by means of upper and lower hinge arms and pivots on the table and on the wall or other supporting structure, thus eliminating the need for roller wheels at the end of the table. In the Bergkamp et al. structure, the table is held in its storage position by gravity due to a bend in the lower arm which places the center of gravity of the table in storage position between the back wall and the lower pivot point of the bent arm. Unfortunately, this type of structure results in a total mechanism depth or thickness which is so great as to either require a recess in the wall to which the table is attached, or a separate box or closet-like structure into which the table can be folded. This is often undesirable because of space limitations in the room or structural limitations that prevent a recess being formed in the wall.

To overcome these and other problems, the present invention provides a folding wall table that does not require rollers on the table, does not require a separate latch to hold the table in its storage position, and which folds compactly against the wall without requiring either a storage box protruding into the room or a recess being formed into the wall.

In Bergkamp et al. type of structure, the table is held in its usable position by means of latches between the table top and the upper hinge arms. This type of structure has the advantage of not requiring separate support legs for the outer end of the table, but it is subject to other disadvantages. These disadvantages are overcome in a preferred embodiment of the present invention by latching the inner edge of the table, in its usable position, directly to the wall, or wall mounting plate or bracket, rather than to the upper hinge arm, and by extending or positioning the inner edge of the table directly adjacent the wall. This provides a much more convenient and less cluttered working surface. Also, by providing latch release means along the opposite or outer end of the table, ease of operation is improved, especially for larger tables. Release of the latches and application of the folding force can then all be provided from the same location with respect to the table.

SUMMARY OF THE INVENTION

According to the present invention there is provided a folding wall table adapted for attachment to a wall and capable of easy movement between a storage position in which it is vertically disposed adjacent the wall, and a usable position in which the table extends horizontally from the wall. The folding wall table includes a table surface member, and hinge means for connecting the table surface member to a wall or other support for folding of the table so that the edge of the table nearest the wall in its usuable position becomes the top edge of the table in its storage position. Latch means are provided for latching the inner edge of the table directly to the wall, or wall mounting plate or bracket, to stabilize the table in its usable position.

According to another aspect of the invention, release means for the latch means may be provided adjacent the outer edge of the table, so that the latches may be released from an operator position at the end of the table.

According to another aspect of the invention, the hinge means may include upper and lower hinge arms and upper and lower wall pivot means for pivotally connecting the upper and hinge arms respectively to a wall with the pivot axis of the upper hinge arms mounted higher that the pivot axis of the lower hing arm. Upper and lower table pivot means are provided for pivotally connecting the upper and lower hinge arm means respectively to the underside of the table surface member, with the pivot axis of the upper table pivot means being positioned closer to the wall, when the table is in its usable position, than the pivot axis of the lower table pivot means. The hinge arm means and the pivot means are positioned and sized so as to allow movement of the table surface member between its usable and storage positions. The pivot axis of the lower table pivot means is spaced below a plane passing through the pivot axis of the upper table pivot means and parallel with the table surface, when the table is in its usable position. This offsetting provides an overcenter resistance force while holds the table in its storage position. The overcenter resistance force is provided by the offset table pivot geometry and in compressional resilience of the lower hinge arm of lower hinge arm table pivot while passing through the overcenter position.

According to another aspect of the invention, the lower hinge arm means may be intentionally made slightly longer than strictly required by geometrical considerations so as to preload the lower hinge arm means in the storage position so as to enhance the overcenter resistance force.

DETAILED DESCRIPTION OF THE PREFERRED EMBODIMENT

Figure 1:
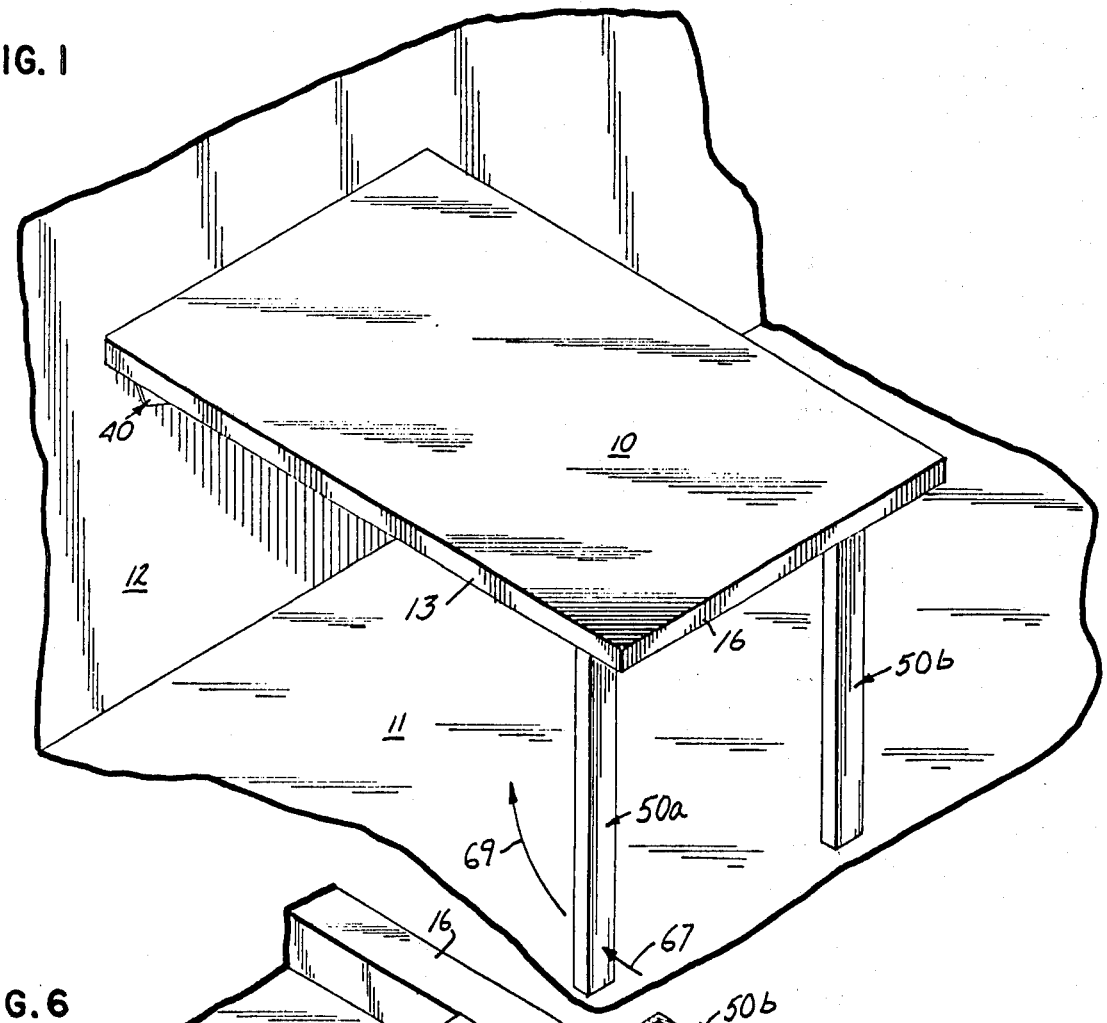
FIG. 1 is a view in perspective of a folding wall table.

In FIG. 1, a folding wall table according to the present invention is shown in its unfolded, or usable position. The present invention is equally applicable to folding tables, desks, and any other type of work surface. Accordingly, although the preferred embodiment is described as a table, the term table is used in this patent application in a generic sense to include any type of work surface. In FIG. 1, the table includes a table surface member 10, and a pair of legs 50*a* and 50*b*. The table is attached to wall 12 as explained hereinafter, and legs 50*a* and 50*b* support the outer end of the table above floor 11.

Figure 2:
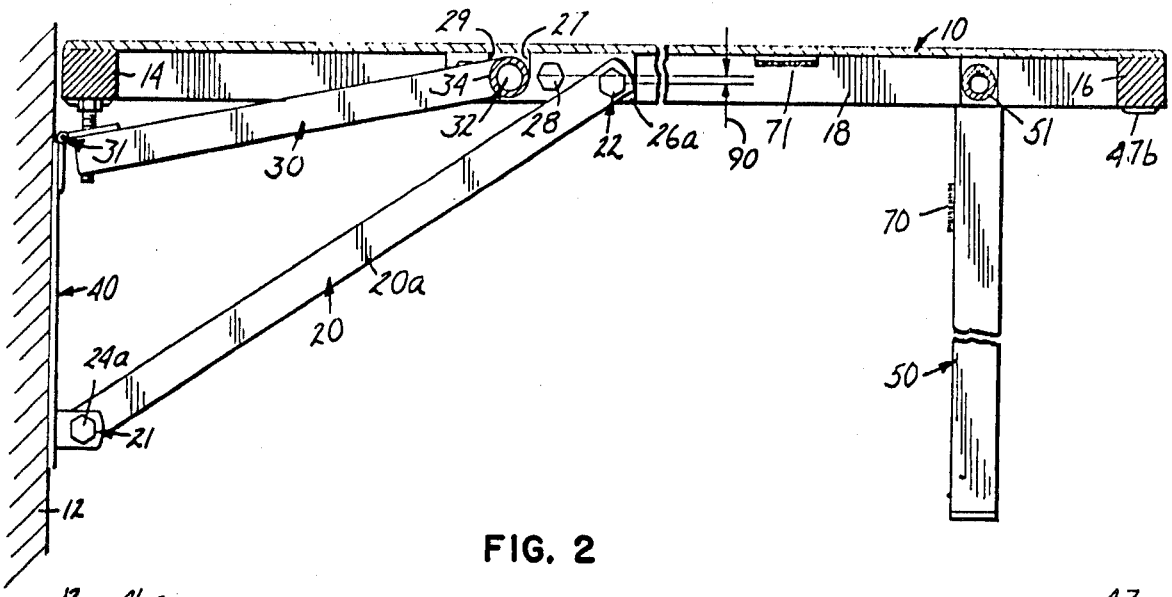
FIG. 2 is a longitudinal section through the table of FIG. 1, portions thereof broken away.
Figure 3:
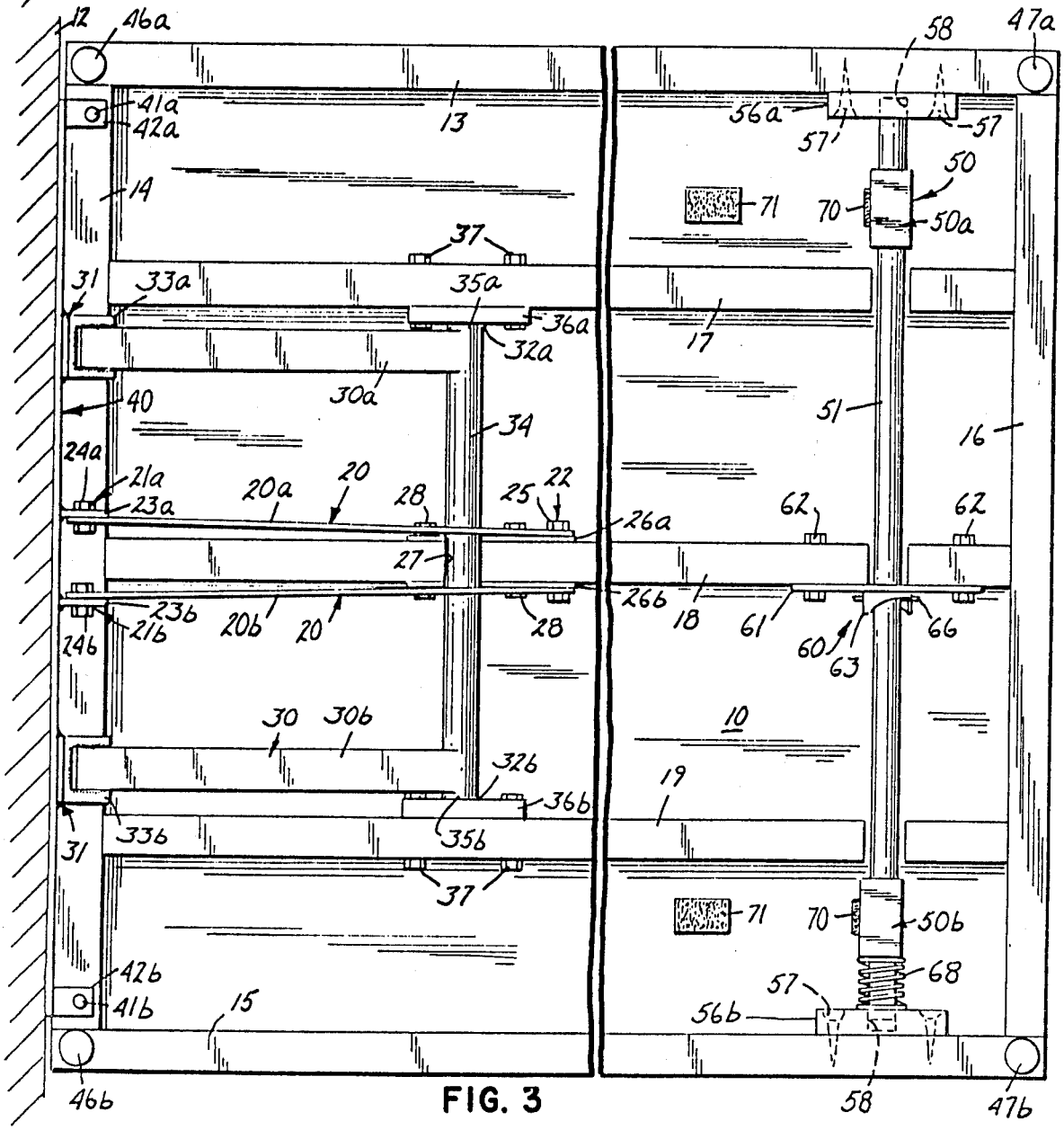
FIG. 3 is a view in bottom plan of the table of FIG. 1.

FIGS. 2 and 3 show the structural details of the preferred embodiment of the present invention. Table surface member 10 is supported and reinforced by a table frame which includes perimeter members 13, 14, 15 and 16, and interior longitudinal frame members 17, 18 and 19. In the preferred embodiment, table surface member 10 and table frame members 13–19 are made of wood, for lightness and strength, although it will be understood that other materials including metal could be used. Table surface member 10 can be made of plywood, hardboard or particle board, with a suitable decorative top surface mounted thereto. Tabletop 10 can be held by screws, nails or glue to the table frame members, and the table frame members are screwed, nailed or glued together.

As best seen in FIG. 2, the table is secured to the wall by means of a linkage including lower hinge arm 20 and upper hinge arm 30. Lower hinge arm 20 pivotally attaches to the wall at a lower wall pivot 21. Similarly, upper hinge arm 30 pivotally connects to the wall at an upper wall pivot 31. Lower hinge arm 20 connects to the table at lower arm table pivot 22, and similarly, upper hinge arm 30 connects to the table at upper arm pivot 32.

Figure 4:
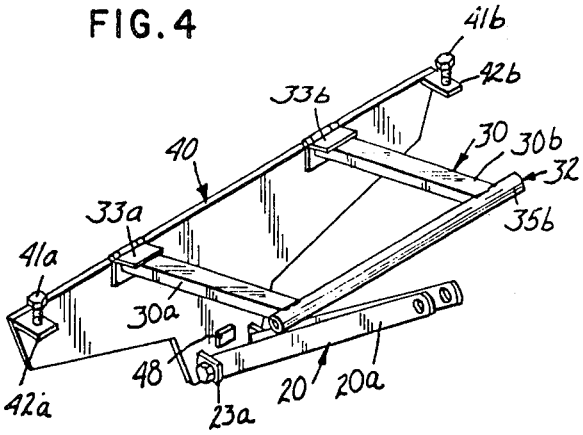
FIG. 4 is a view in perspective of the hinge assembly for the table of FIG. 1.

In the preferred embodiment, each of the lower hinge arm and the upper hinge arm comprise a pair of arms, as best seen in FIGS. 3 and 4. Wall mounting plate 40 is generally flat and is adapted to be secured to the wall by bolts or any other suitable means (not shown). Wall mounting plate 40 includes a pair of pad eyes 23*a* and 23*b* which may be welded thereto to form the lower wall pivots for the lower hinge arms. The lower hinge arm 20 in the preferred embodiment comprises a pair of metal bars or straps 20*a* and 20*b* mounted on a common axis at the lower wall pivot 21. Specifically, lower hinge arm 20*a* is pivotally mounted to pad eye 23*a* by means of a bolt 24*a*. In similar manner, lower hinge arm 20*b* is pivotally mounted to pad eye 23*b* by a pivot bolt 24*b*.

Upper hinge arm 30 in the preferred embodiment includes a pair of rectangular tubular arms 30*a* and 30*b*. These arms are pivotally connected to wall mounting plate 40 at the upper wall pivot point 31. Specifically, upper hinge arm 30*a* pivotally connects to wall mounting plate 40 by means of a hinge 33*a* which includes a hinge pin and hinge plates attached to the wall mounting plate 40 and upper hinge arm 30*a*. In the same manner, upper hinge arm 30*b* connects to wall mounting plate 40 by means of hinge 33*b*.

Figure 5:
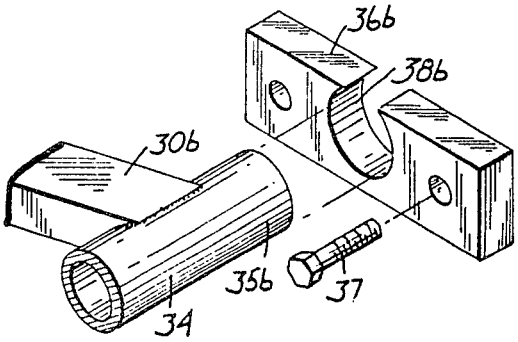
FIG. 5 is an exploded fragmentary detail of a hinge arm pivot used in the present invention.

The other ends of upper hinge arms 30*a* and 30*b* are welded to a tubular crossbar 34. Crossbar 34 has end portions 35*a* and 35*b* which extend outwardly of upper hinge arms 30*a* and 30*b* respectively, and which fit into pivot blocks attached to the table. A notch 27 is provided in table frame member 18 to provide clearance for crossbar 34. As seen in FIG. 3, end 35*a* of crossbar 34 fits into a pivot block 36*a* which is secured to frame member 17 by means of bolts and nuts 37. In the same manner, end 35*b* of crossbar 34 fits into pivot block 36*b* which is secured to frame member 19 by bolts 37. The configuration of pivot block 36*b* is shown in greater detail in FIG. 5. The block includes a cylindrical bore 38*b* which receives end 35*b* of crossbar 34 and serves as a journal bearing therefor. Pivot block 36*b* is preferably made of polyproplene, nylon or similar plastic.

Alternatively, pivot blocks 36 could be moded with a cylindrical projection which would be received inside crossbar 34 to form the pivot bearing.

The axis of crossbar 34 as positioned with respect to the table by pivot blocks 36*a* and 36*b* defines the upper hinge arm table pivot 32. The lower hinge arm table pivot 22 is defined by pivot bolt 25 which pivotally connects lower hinge arms 20*a* and 20*b* to table frame member 18. Metallic reinforcing plates 26*a* and 26*b* can be secured by bolts and nuts 28 or any other suitable means to the sides of table frame member 18. Reinforcing plates 26*a* and 26*b* have slots 29 through which crossbar 34 passes. Slots 29 provide a further bearing surface for the pivotal motion of crossbar 34. More importantly, reinforcing plates 26 provide more rigid control over the critical dimension between the table pivot axes 22 and 32, by virtue of the fact that pivot bolt 25 and crossbar 34 are both positively located with respect to each other by the reforcing plates. This prevents unwanted bowing of crossbar 34 as explained more fully hereinafter.

Figure 6:
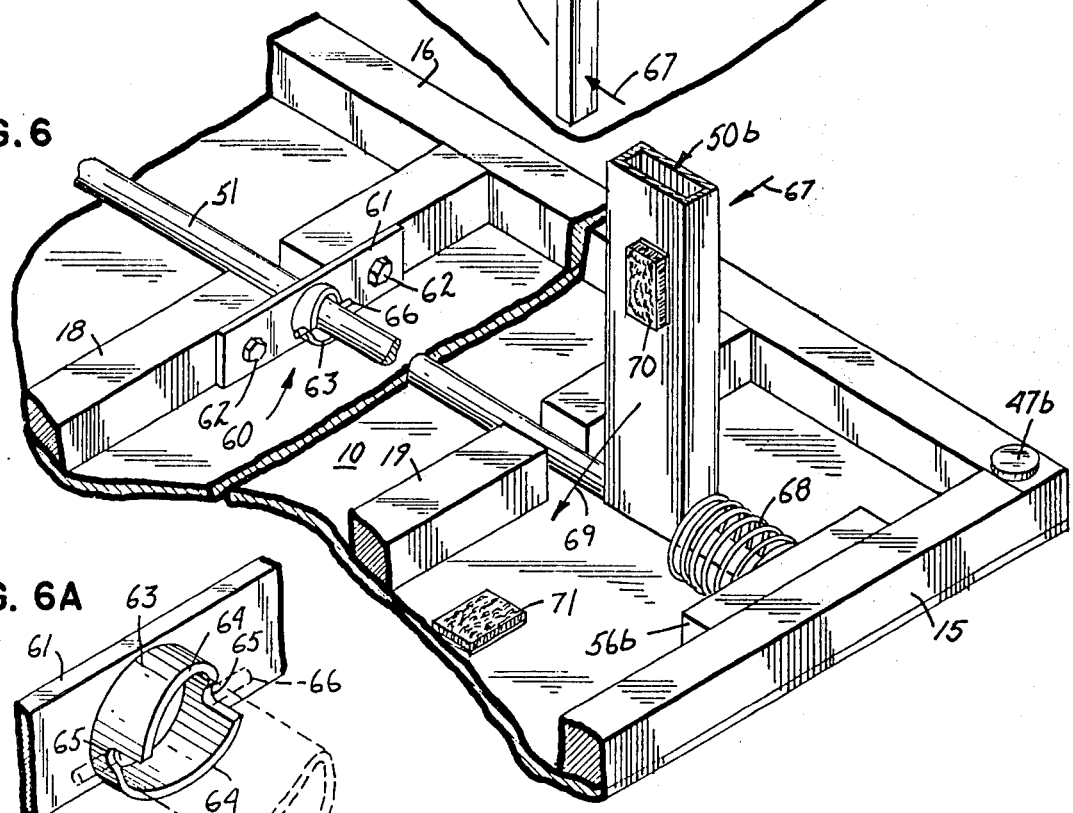
FIG. 6 is a fragmentary detail in perspective of the leg locking assembly of the table of FIG. 1.

Folding leg assembly 50 includes a pair of legs 50*a* and 50*b*. As seen in FIGS. 3 and 6, the legs may be made of rectangular metallic tubing. Individual legs 50*a* and 50*b* are welded to a crossbar 51 which is positioned in notches 52, 53 and 54 provided in table frame members 17, 18 and 19 respectively. End 55*a* of crossbar 51 extends beyond leg 50*a*, and similarly end 55*b* of crossbar 51 extends beyond leg 50*b*. The crossbar ends are mounted for pivotal movement in pivot blocks 56*a* and 56*b* which are mounted respectively to table frame members 13 and 15 by means of screws 57. Bores 58*a* and 58*b* are provided respectively in pivot blocks 56*a* and 56*b*, to receive the ends of crossbar 51. Bores 58*a* and 58*b* have sufficient depth, with respect to the length of crossbar 51, to permit a degree of axial movement of crossbar 51, as well as rotational movement.

Figure 6A:
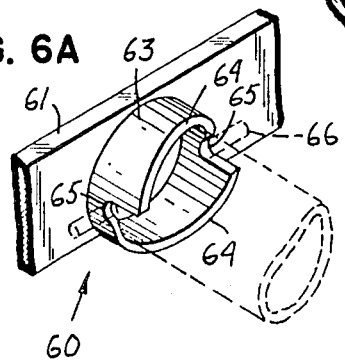
FIG. 6A is an enlarged fragmentary detail of a portion of FIG. 6.

As seen more clearly in FIGS. 6 and 6A, a leg position lock 60 is provided. Leg position lock 60 comprises a mounting plate 61 which is attached to table frame member 18 by means of bolts 62. Plate 61 has a clearance aperture therethrough for receiving crossbar 51. Flange 63 is welded to mounting plate 61 around the opening. Flange 63 includes a pair of cam surfaces 64 generally in the configuration of a ramp, and a pair of detent slot portions 65. A pin 66 secured in an opening bored transversely through crossbar 51 and projecting therefrom on either side cooperates with cam surfaces 64 and detent slots 65 to help hold the legs in their extended position.

To fold the legs, the user pushes the leg in a direction indicated by arrow 67. This causes the pin to ramp up the cam surfaces, causing cross bar 51 to move axially against the force of spring 68 which is provided between leg 50*b* and pivot block 56*b*.

The legs move through an arc indicated by arrow 69 to a position against the table surface member with leg 50*a* between table frame members 13 and 17, and leg 50*b* between frame members 19 and 15. In the preferred embodiment, the table legs are made no thicker than the table frame members so as to provide a compact narrow profile when the legs are folded up.

Legs 50 are held in the folded position by patches 70 and 71 of a synthetic hook and loop type fastening material, attached to the legs and the underside of the table surface member, respectively.

To unfold the legs, the legs are manually pulled away from the fastening material to a vertical position, with spring 68 and leg position lock 60 helping to hold them in the vertical position.

Figure 7:
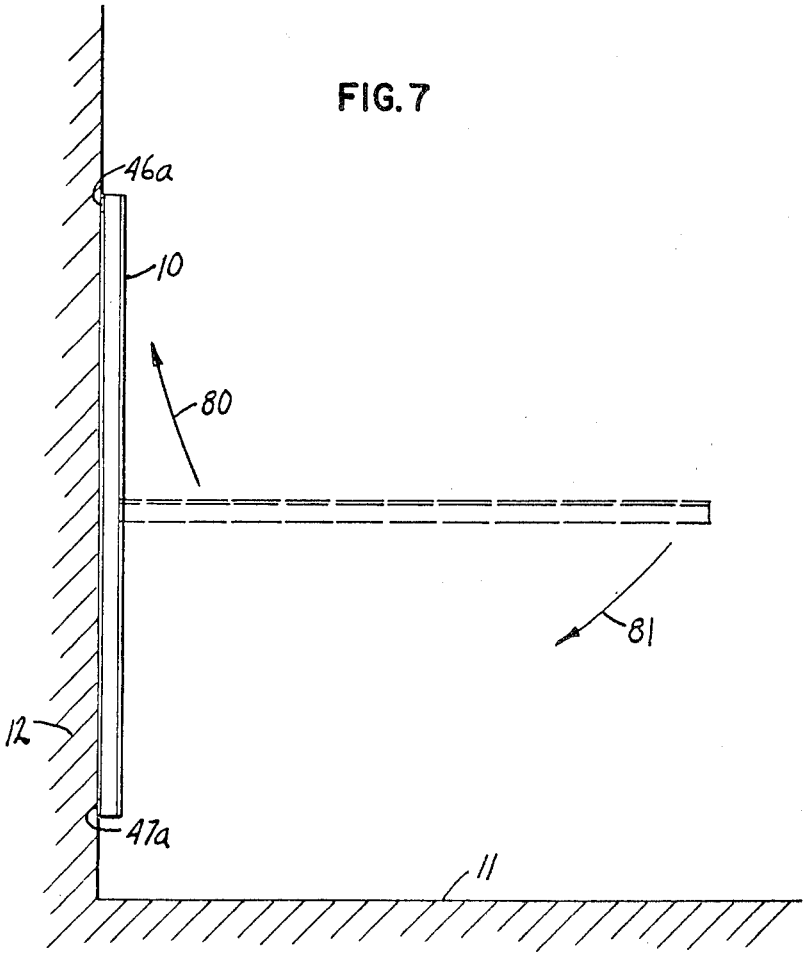
FIG. 7 is a diagrammatic view in side elevation of the wall table in storage position.

Once the legs have been folded up, the table can be folded against the wall. As seen in FIGS. 1 and 7, the end of table surface member 10 nearest the wall moves upwardly as indicated by arrow 80, while the outer end moves downwardly and inwardly as indicated by arrow 81. In the folded position, table surface member 10 is closely adjacent and parallel to wall 12. The fold-up path followed by the table during the folding and unfolding operation is controlled by the geometry of the hinge assembly including the upper and lower hinge arms and the various pivots.

As previously discussed, it is generally known in the prior art to provide a linkage or hinge assembly connected between a wall or support and a table or other generally planar member, for controlling movement of the table between a horizontal position and a vertical position against the wall. The lengths of the upper and lower hinge arms, and the positioning of the pivots along the wall and along the center line of the table or other planar member can be selected to provide the desired motion. Generally there is an infinite set of different possible geometries which will give the desired motion.

However, when the "correct" geometry is achieved according to the prior art, the table will tend to swing freely away from the wall under the influence of gravity, to come to rest at some intermediate position. Thus, it has been necessary in prior art devices to either provide counterbalance or biasing springs, high pivot friction, or latch means to hold the table in its vertical position.

The present invention intentionally modifies the linkage geometry away from the "correct" geometry of the prior art in a particular manner, so as to provide a linkage which will automatically maintain the table in its stored position, without the need for any latch, counterbalancing springs, or the like. The manner in which this feature is obtained is explained as follows.

Figure 8:
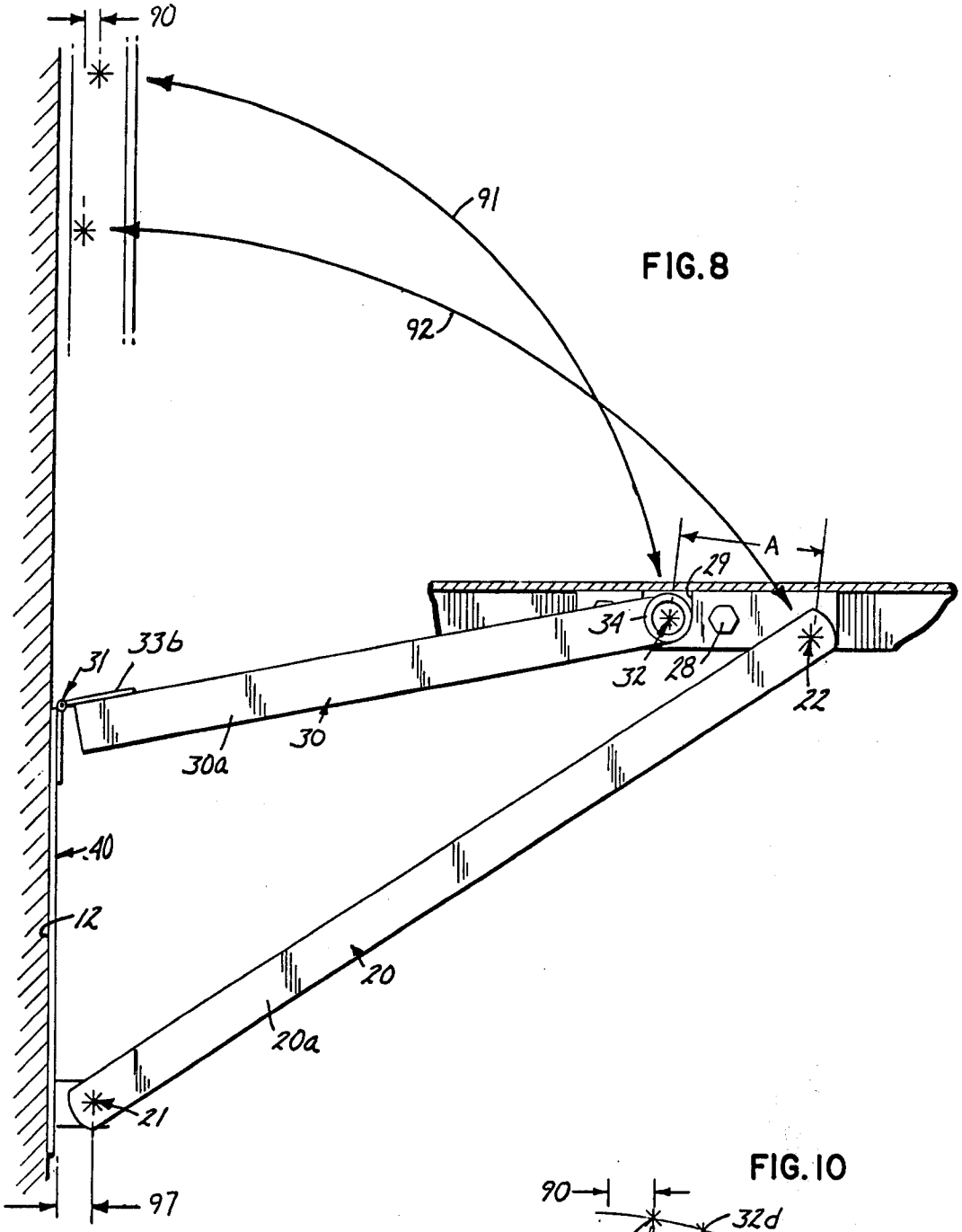
FIG. 8 is a fragmentary side elevation view showing the geometry of the hinge arms according to the present invention.

FIG. 8 shows the basic geometry of the hinge linkage. Reference number 30 indicates the upper hinge arm, and reference number 20 designates the lower hinge arm. The upper arm wall pivot, which is the point about which upper hinge arm 30 may pivot, is indicated by reference number 31. Reference number 21 indicates the lower arm wall pivot. The point, or more properly axis, about which table 10 and upper hinge arm 30 are pivotable with respect to each other is indicated by reference number 32. The corresponding pivotal connection between table 10 and lower hinge arm 20 is indicated by reference number 22. The resulting geometry can be thought of as a four bar linkage, with arm 20, arm 30, the wall or wall plate between pivots 31 and 21, and the table surface member between pivots 32 and 22 making up the four elements.

When the table is in its folded position, arms 20 and 30 and table 10 are approximately aligned in the same plane, but instead of mounting table pivot points 22 and 32 in the same plane parallel to table 10, these pivot points are intentionally offset by an amount indicated by reference number 90 in FIGS. 2 and 8. Upper arm table pivot 32 is intentionally placed higher (closer to the table surface) than lower arm table pivot 22.

The arc travel by pivot point 32 is a circle centered at 31, and is indicated by reference number 91. The arc normally traveled by lower arm table pivot 22 is an arc indicated by reference number 92, centered at pivot point 21.

By providing offset 90, and by making corresponding adjustments in the lengths of the hinge arms, it is possible to provide a built-in resistance force to hold the table in its vertical position. The resistive force is supplied by resilient forces in one or more of the hinge arms caused by an overcenter condition when the table is near the storage position.

Figure 9:
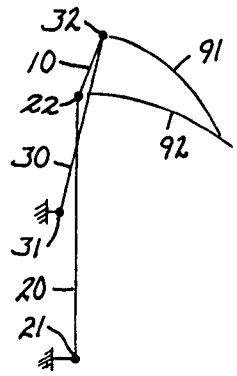
FIGS. 9 and 10 are diagrammatic views illustrating the geometry of the hinge assembly according to the present invention.

This is better explained with the help of the diagram of FIG. 9. In FIG. 9, the arms and pivots are numbered as before, with the arms indicated only by a single straight line. Offset 90 is exaggerated for purposes of illustration. In FIG. 9, the table is in its storage position adjacent and parallel to the wall. For the given pivot point placement, it is apparent that something in the linkage will have to undergo deformation in order to unfold the table. In the vertical position shown, pivot 22 is closer to the wall than pivot 32. However, as the table is unfolded to its horizontal position (rotating counterclockwise in FIGS. 8, 9 and 10) pivot 22 must pass outwardly to a position beneath pivot 32, and then further outwardly on arc 92 before pivot 32 has moved very far outwardly and downwardly on arc 91. (Of course the wall prevents pivot 32 from moving outwardly and downwardly ahead of pivot 22, which would otherwise result in bringing the table down "upside down").

However, the initial movement of pivots 22 outwardly to a position approximately beneath pivot 22 will cause binding or deformation of the linkage. Specifically, hinge arm 30 might be stretched, hinge arm 22 might by compressed, or table pivots 32 and 33 might be moved towards each other. In the preferred embodiment, lower hinge arm 20 is designed to compress or shorten its length slightly by bending or bowing away from the plane of the drawing of FIG. 9. This is achieved by making the upper hinge arms 30 relatively stiff and rigid since they are made of metal tubular sections, while lower hinge arms 20 are made of relatively thin bar stock. As a result, lower hinge arms 20, although having adequate strength in a vertical plane, are relatively flexible in a transverse or lateral plane. During the above-noted compression of the lower hinge arms, hinge arms 20*a* and 20*b* bow outwardly or inwardly slightly to achieve the resilient compression of lower hinge arm 20. Also in the preferred embodiment, reinforcing plates 26*a* and 26*b* prevent pivots 22 and 32 from being moved together by bowing of crossbar 34.

Figure 10:
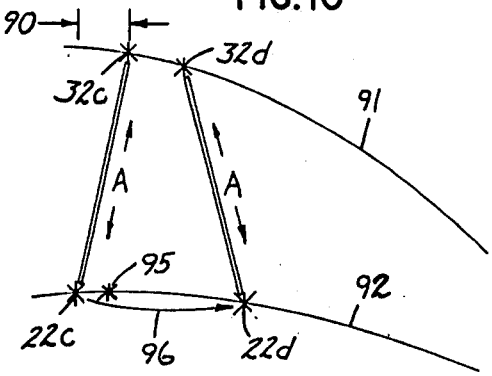

The overcenter resistance effect is seen further in FIG. 10. From an observation of arcs 91 and 92 it is seen that these arcs are farthest apart close to the wall, and they become increasingly close together as the pivots move away from the wall. In FIG. 10, a point indicated by reference number 32*c* indicates the position of upper arm table pivot 32 when the table is in the full vertical storage position. The point indicated by reference number 22*c* is the position of lower arm table pivot 22 with the table in the full vertical storage position. The offset 90 between these points is again exaggerated for purposes of illustration. The distance on table surface member 10 between table pivots 32 and 22 is fixed, and is indicated in FIG. 10 by dimension A.

It will be appreciated that the shortest distance between point 32*c* and arc 92 falls at a position approximately vertically beneath point 32*c*, indicated by reference number 95. It will also be appreciated that dimension A is greater than the distance from point 32*c* to point 95. Since the initial motion upon unfolding the table requires pivot point 22 to move outwardly beyond pivot point 32, it is clear that binding will result. Since the dimension A is assumed not to change significantly, lower arms 20 deflect and shorten, allowing pivot point 22 to move from point 22*c* along the path indicated by arrow 96, which is displaced from arc 92. This displacement is accommodated by flexing or bowing of lower hinge arms 20*a* and 20*b* as previously explained.

The above described situation would exist if a portion of wall 12 near the top of the table in its stored position were cut away. In normal situations, the top of table 10 immediately butts into wall 12 when the table is first moved away from its stored position, thus preventing stationary rotation about point 32*c* while pivot point 22 is moved past the point of maximum resistance. Instead, pivot point 32 is caused to move a short distance to a point indicated by reference number 32*d* while pivot 22 is moving from pivot 22*c* to point 22*d*. Since the distance between arcs 91 and 92 decrease as pivot 32 is moved to the right, this has the effect of increasing the mismatch in distance between dimension A and the shortest distance to arc 92. In this case, the point 75 would be shifted somewhat to the right. Thus, the effect of the top end of the table butting against the wall is to increase the overcenter resistance effect somewhat. Nylon glides 46*a* and 46*b* are preferably provided on the underside of the table, for example on table frame member 41, to provide bearing surfaces for preventing damage to the wall. Additionally, suitable bearing plates or strips (not shown) can be provided on the wall at corresponding points for engagement by the glides.

After moving past the point of maximum deflection, table pivot 22 comes to position 22*d* while table pivot 32 comes to position 32*d*. In this position, table pivot 22 is back on arc 92, and from this point on while lowering the table both pivots 22 and 32 can proceed outwardly and downwardly on arcs 92 and 91 respectively, with the angular positioning of the table moving as controlled by the geometry.

It has been found that the overcenter resistance force caused by offset 90 as described above can be enhanced for better results as follows. The length of lower hinge arm 20 can be selected to provide a preload into the hinge assembly. With the table in its vertical position, the length required for lower hinge arm 20 is initially calculated by noting that all four elements of the equivalent four bar linkage are approximately aligned, disregarding for the moment various offsets which actually amount to only a few degrees variation in the orientation of the various links. The length of arm 20 would then be initially calculated as the length of arm 30 plus the distance between pivot points 21 and 31, less the distance between pivot points 22 and 32. However, the length of arm 20 is next selected to be slightly longer than this initial value. This has the effect of placing arm 20 in compression, with bowing of the lower arms 20*a* and 20*b* when the table is in its full storage position. This preloads the arms so that when the table is brought away from storage position through the overcenter position, the resistance force will be greater.

Additionally, lower wall pivots 21 can be displaced by an offset 97 to extend farther from the wall than upper wall pivot 31. This has the effect of placing lower hinge arm 20 in a more nearly vertical, or slightly beyond vertical position than would be the case if pivot 20 were placed closer to the wall. Offset 97 causes the compression and bowing in the lower hinge arms 20*a* and 20*b* to be increased as the table passes through the overcenter point of maximum resistance, further increasing the resistance force.

The three factors of table pivot position offset 90, lengthening of the lower hinge arm for preloading, and offset 97 for the lower wall pivot combine to provide the overcenter resistance force to hold the table surface member in its vertical position. In the preferred design, the overcenter compression forces are not fully relaxed when the table is up against the wall, so as to maintain a residual force holding the table against the wall. This prevents the table from sagging away from the wall which it might otherwise do due to mechanical play and tolerance in the pivots.

As the table is moved to its usable position, it is stopped in a horizontal position by stop bolts 41*a* and 41*b*. These bolts are threaded into tabs 42*a* and 42*b* formed in wall mounting plate 40 (FIG. 4). In the usable position, the underside of table frame member 14 butts against the tops of stop bolts 41*a* and 41*b*. These stop bolts can be threaded inwardly or outwardly as required for horizontal orientation of the table.

When raising the table, legs 11 are first folded up as previously explained. The outer edge of the table is then moved downwardly and inwardly, causing the inner edge of the table to move upwardly. Just before reaching the storage position, increasing resistance is encountered while going through the point of maximum deflection of the lower hinge arms. On further movement of the table, the maximum point is passed and the compression force in the lower hinge arms helps to push the table snugly against the wall or its stops. The table will not fall away from this position on its own, since to do so would require an input of force to overcome the overcenter resistance force.

Additional glides or rubber bumpers 47*a* and 47*b* may be provided on the underside of the table or the table frame members near the outer end of the table as indicated in FIG. 3. Bumpers 47*a* and 47*b* together with glides 46*a* and 46*b* provide the contact points when the table is in its vertical storage position against the wall, as seen in FIG. 7. In case the lower portion of the wall below mounting plate 40 is cut back or cut away, a bumper or stop 48 can be provided attached to wall mounting plate 40 as seen in FIG. 4. Bumper 48 is positioned for engagement by the center table frame member 18 when the table is moved to its storage position.

As an example illustrating the practical application of the principles set forth above according to the present invention, the pertinent dimensions will be set forth for one successful embodiment of the invention. In this example, the table surface is 48 inches long, it being understood that the width of the table in a direction parallel to the wall is immaterial. The table surface is approximately 29 inches above the floor when the table is in its usable position. The wall mounting plate 40 is positioned on the wall so that the upper wall pivot axis 31 is approximately 26 and $\frac{3}{8}$ inches above the floor. The effective length of the upper pivot arm 30 from pivot center 31 to pivot center 22 is 12 inches. The effective length of lower hinge arm 20 from pivot center 21 to pivot center 22 is 16 and $\frac{3}{4}$ inches. The vertical component of the distance between wall pivot center 31 and wall pivot center 21 is 7 and $\frac{1}{2}$ inches. The horizontal component of the distance between pivot center 31 and pivot center 21 (offset 97 in FIG. 8) is $\frac{5}{8}$ inch. The component of the distance between table pivot center 32 and table pivot center 22 in a direction parallel to the table surface is 2 and $\frac{3}{4}$ inches. The component of the distance between table pivot center 32 and table pivot center 22 in a direction perpendicular to the table surface (offset 90 in FIGS. 2 and 8) is $\frac{1}{4}$ inch.

While the above dimensions pertain to a particular preferred embodiment of the invention, it will be appreciated that different sets of dimensions can be selected according to the principles set forth herein. In particular, for longer tables, the dimensions would have to be adjusted accordingly.

It will further be appreciated that although the deformation which results when passing through the overcenter point in the preferred embodiment is accommodated by compression in the lower hinge arm 20, the present invention also contemplates that the deformation could be accommodated by resilient lengthing of upper hinge arm 30, or resilient bowing of crossbar 34 which would have the effect of shortening dimension A between the table pivot centers. Control of resilient deformation of the various members is achieved by selection of the materials and thicknesses. It would also be possible to provide a spring-loaded telescopic arrangement for one or more of the control arms to accommodate the overcenter forces.

It will also be appreciated that although the preferred embodiment of the present invention disclosed herein uses a pair of upper hinge arms spaced on either side of a pair of lower hinge arms, when viewed from the top or bottom, any number of individual arms or spacings can be used without departing from the scope of the present invention. For example, it would be a simple manner to space the lower hinge arms farther apart with the upper hinge arm or arms therebetween.

Turning to FIGS. 11–18, an alternate form of the applicant's folding wall table is shown. In the alternate form, the table supporting legs at the outer end of the table have been eliminated, and the table is secured in its usable position by latch means associated with the end of the table nearest the wall and the wall mounting assembly. While any type of hinge assembly can be used in conjunction with this alternate form of the folding wall table, in the preferred embodiment thereof it is advantageous to use hinge arms and pivots according to the principles set forth above in the description of the embodiment of FIGS. 1–10. In the preferred embodiment of this alternate form of the invention, as shown in FIGS. 11–18, the geometry of the hinge arms and pivots, while following the same principles as set forth above, have been optimized for this embodiment without legs, and a number of other modifications have been made to the table frame and wall mounting assembly as explained hereinafter.

Figure 11:
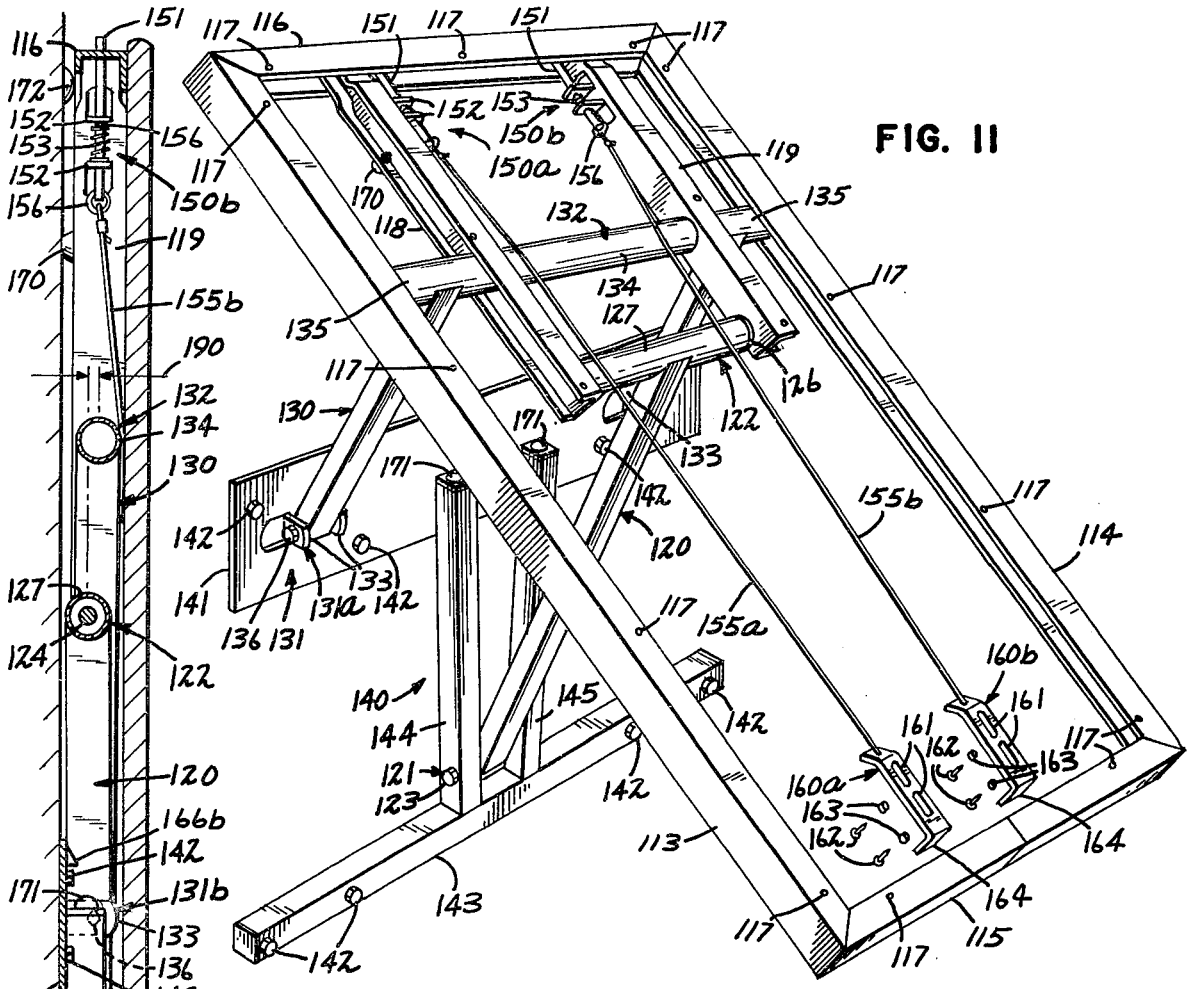
FIG. 11 is a view in perspective of a preferred embodiment of a wall table according to the present invention, the top being removed for clarity of illustration and the table being depicted in an intermediate position between usuable and storage positions.
Figure 16:
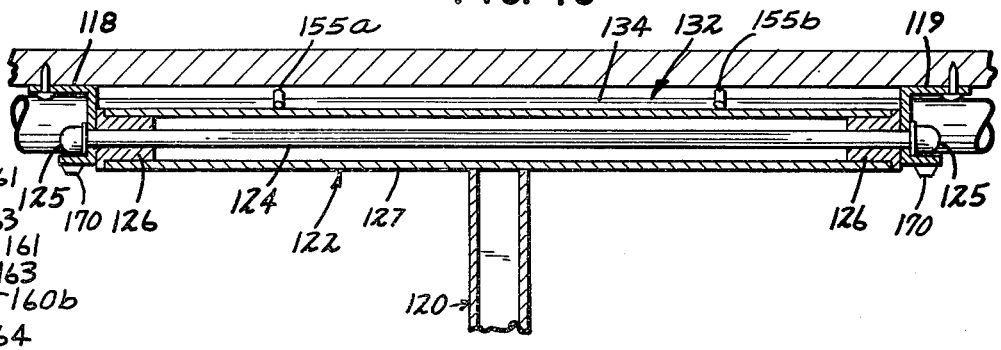
FIG. 16 is an enlarged detailed sectional view as seen from the line 16—16 of FIG. 13.

Referring specifically to FIG. 11, the table surface member has been removed in order to show the other components more clearly. The table frame is composed of a pair of side frame members 113 and 114, and a pair of end frame members 115 and 116. These frame members are made of metal channel stock, with the top channel leg being longer than the lower channel legs, as also seen in FIG. 16, so as to provide bolt clearance. The frame members may be welded or otherwise secured together to form a generally rectangular frame, and a plurality of bolt or screw holes 117 are provided in the top channel legs of the frame members for securing the table surface member. As in the previous embodiment, the table surface member can be made of plywood, hardboard or particle board with a suitable decorative top surface mounted thereto.

A subframe comprises a pair of channel members 118 and 119, which are positioned parallel to side frame members 113 and 114, and which are welded or otherwise secured at one end to frame member 116. Subframe channel members 118 and 119 also have bolt or screw holes 117 for securing a table surface member. It will be understood that the table surface member also serves to positionally secure the outer ends of subframe channel members 118 and 119 with respect to the main frame.

Wall mounting assembly 140 may comprise a large wall mounting plate similar to plate 40 of the embodiment of FIGS. 1–10. In the embodiment of FIG. 11, wall mounting assembly 140 can conveniently be made from a rectangular plate 141 which is adapted to be bolted to wall 11 by means of a plurality of bolts 142. A wall mounted member 143, which may be a rectangular sectioned tube is positioned below and parallel to plate 141, and is connected therewith by means of a pair of vertical members 144 and 145. These vertical members can also be made of vertical members 144 and 145.

These vertical members can also be made of rectangular tubes, and they may be welded or otherwise secured to both member 143 and plate 141. Plate 141, and members 143–145 comprise the wall mounting assembly, and additional bolts 142 can be provided in member 143, and also in members 144 and 145 if necessary, for holding the assembly to the wall.

The folding table is connected to the wall mounting assembly by means of an upper hinge arm 130 and a lower hinge arm 120, which correspond functionally to upper and lower hinge arms 30 and 20, respectively, of the embodiment of FIGS. 1–10. Upper hinge arm 130 comprises a pair of individual arms **130*a* and 130*b*. In the preferred embodiment, these arms are made of rectangular sectioned metal tubes. Hinge arm 130*a* is pivotally connected to the wall mounting assembly by means of an upper wall pivot 131*a*. In the preferred embodiment, pivot 131*a* is formed by a pair of tabs which are die-cut from plate 141, then bent perpendicularly thereto. A pivot bolt 136 passes through holes in tabs 133 and through the end of arm 130*a* to form the pivot. An identical pivot is provided for the upper wall pivot of upper hinge arm 130*b*. In the preferred embodiment shown in FIGS. 11–18, a single lower hinge arm 120 is used, although it will be appreciated that a pair of arms could be provided as in the embodiment of FIGS. 1–10. Lower hinge arm 120 is made of rectangular sectioned metal tubing, and it is pivoted at its lower end by means of a lower wall pivot 121. This pivot may be formed by a pivot bolt 123 passing through vertical members 144 and 145, and the lower end of hinge arm 120** which is positioned therebetween.

The upper ends of upper hinge arms **130*a* and 130*b* are welded to a circular crossbar 134. Crossbar 134 extends through holes provided in subframe channel members 118 and 119, so as to form the upper arm pivot generally designated by reference number 132. Crossbar 134 is free to rotate, but is otherwise constrained by subframe members 118 and 119. The ends of crossbar 134 which extend beyond the points of connection of upper hinge arms 130*a* and 130*b* are designated by reference number 135. Ends 135 extend inside the channels of side frame members 113 and 114** in close proximity to the web portions thereof, thus preventing unwanted lateral movement of the table.

Lower hinge arm 120 connects to the table at a lower arm table pivot generally indicated by reference number 122. The details of construction of this pivot are shown more clearly in the sectional view of FIG. 16. In FIG. 16, subframe channel members 118 and 119 are shown in sections, as is table surface member 10 which is secured thereto by means of screws. A pivot bolt 124 passes through pivot holes provided in both subframe channel members 118 and 119, and is secured in place by caps 125 provided at each end.

Lower hinge arm 120 is welded to a circular tubular pivot tube 127. Pivot tube 127 is positioned coaxially with respect to pivot bolt 124, and is spaced in relationship thereto by means of nylon or steel bushings 126 at each end thereof. Bushings 126 are designed to fit telescopically into the ends of pivot tube 127, as the bushings also have a central bore sized to accommodate pivot bolt 124. Pivotal movement of lower hinge arm 120 with respect to the table is accommodated by relative angular motion between bushings 126 and pivot bolt 124.

Figure 14:
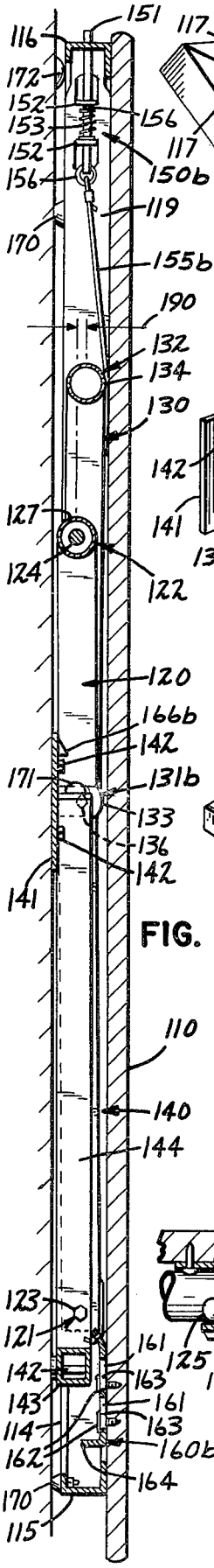
FIG. 14 is a view similar to FIG. 13, but showing the table in its storage position.
Figure 15:
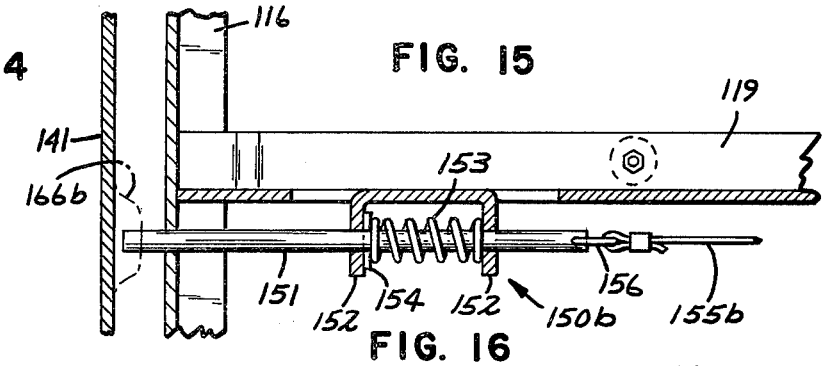
FIG. 15 is an enlarged detailed sectional view as seen from line 15—15 of FIG. 13.
Figures 12, 13, 17, 18:
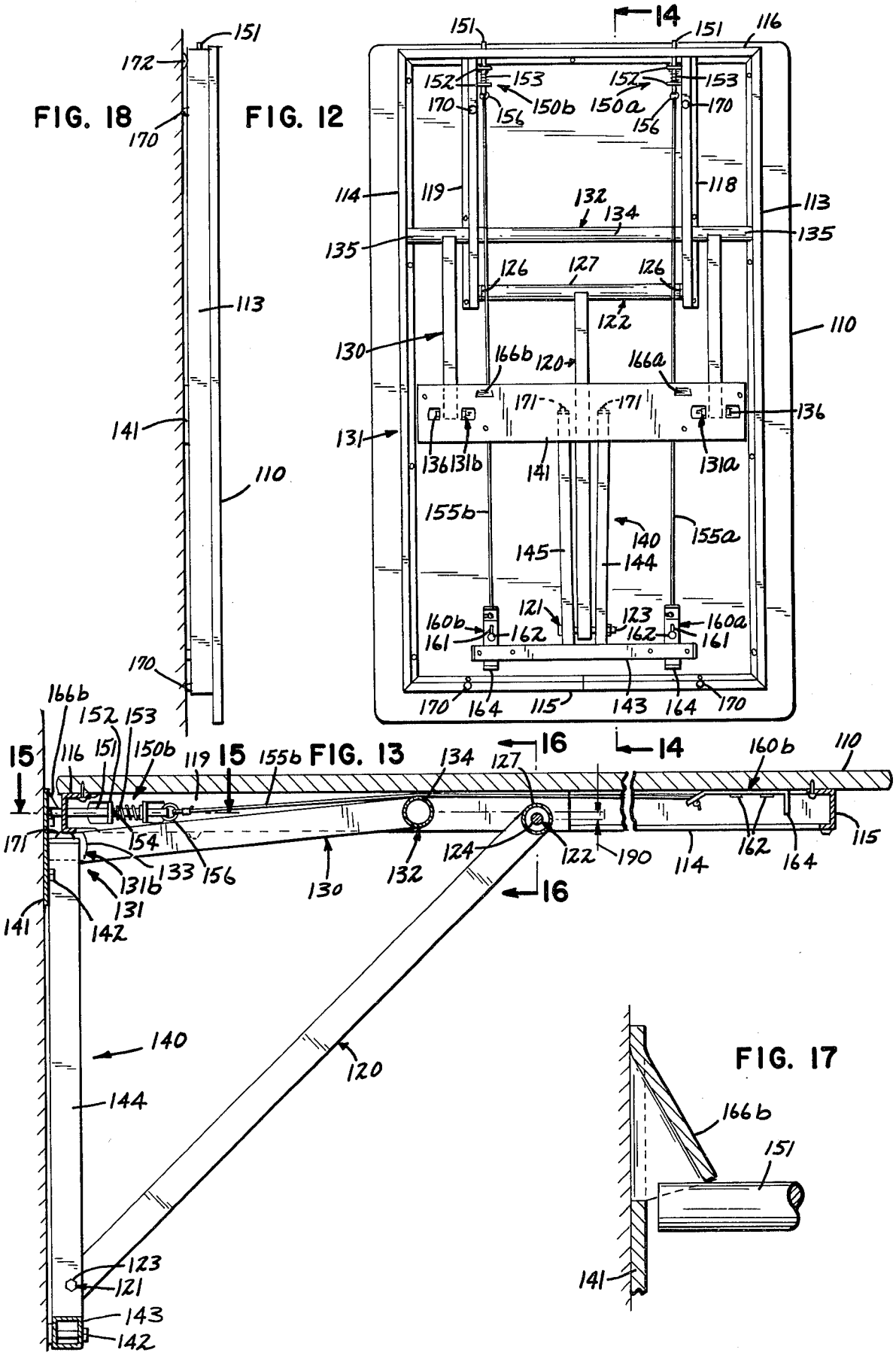
FIG. 12 is a rear elevational view of the table of FIG. 11 showing the table parts in a storage position.
FIG. 13 is an enlarged sectional view of the table of FIG. 11 as seen from the line 13—13 of FIG. 12, but showing the table mounted on a wall in its usable position.
FIG. 17 is an enlarged detailed sectional view of a portion of the latching mechanism seen in FIG. 13.
FIG. 18 is a side elevational view as seen from the right to left of FIG. 12 showing the table in its storage position mounted on a wall.

The table is shown in its vertical storage position in FIGS. 14 and 18, in an intermediate position in FIG. 11, and in its horizontal or usable position in FIG. 13. The table does not require outer legs as in the embodiment of FIGS. 1–10, but instead is maintained in its horizontal position by latches. In the preferred embodiment, a pair of latch assemblies **150*a* and 150*b* are attached to subframe channel members 118 and 119, respectively. The latch assemblies are identical, and one of them (150*b*) is shown in greater detail in FIG. 15. Latch assembly 150*b* includes a latch bolt or pin 151. A pair of tabs 152 are die cut from the web portion of the subframe channel member and are bent outwardly at a right angle. Tabs 152 have clearance holes to receive latch bolt 151. A coil spring 153 is placed coaxially around bolt 151 between tabs 152, and is in abutment with a retaining pin 154 which is placed through a small drill hole in bolt 151, extending outwardly on both sides. The other end of spring 153 is in abutment with the tab 152 farthest from end frame member 116. In this manner, spring 153 normally urges latch bolt 151 inwardly towards end frame member 116**, nearest the wall.

A control cable **155*b* is connected to the outer end of latch bolt 151 by any suitable means, for example by means of a ring 156 provided through a drill hole near the end of bolt 151. As seen in FIG. 11, control cables 155*a* and 155*b* from the two latch assemblies extend beneath the table surface outwardly to a pair of release brackets 160*a*, 160*b* positioned just inside of outer end frame member 115. Control cables 155*a* and 155*b* are routed above crossbar 134 and pivot tube 127**.

Release brackets **160*a* and 160*b* have generally flat central portions which have a pair of slots 161 formed therein. The release brackets are slidably secured to the underside of the table surface members by screws 162 and inserts 163 which fit in slots 161 and through which the screws pass. The ends of the release brackets nearest the outer end of the table have downturned tab portions 164** which form release handles.

Striker plates for cooperating with latch assemblies **150*a* and 150*b* are provided in plate 141 of ball mounting assembly 140. Striker plates 166*a* and 166*b* are shown in FIGS. 12, 13 and 14, although they are not clearly visible in FIG. 11 because they are obscured by other structure. The striker plates can be separate elements welded to the wall mounting assembly, but in the preferred embodiment the striker plates are die cut in plate 141, then bent outward at an angle. An enlarged detail is shown in FIG. 17. Striker plate 166, after being die cut from plate 141, is bent out at an angle to form a ramp and a catch for latch bolt 151. When the table is being moved to its horizontal usable position, latch bolts 151*a* and 151*b* are brought into contact with the ramp portions of striker plates 166*a* and 166*b*, causing retraction of the latch bolts against their springs 153. When the table reaches its full horizontal position, the latch bolts clear the ramp portions of the striker plates and snap back into the position shown in FIG. 17**. In this position, the latch bolts prevent further movement or folding of the table.

To fold the table, the latches are released by grasping the handles 164 of release brackets 160 beneath the table and pulling them towards the outer end of the table. This causes retraction of the latch bolts, permitting upward and inward movement of the table to the storage position against the wall.

Bumpers 170 made of hard rubber or other suitable material are secured to the underside of the table frame members to cushion the movement of the table into the wall during the folding operation and to bear against the wall while the table is in that position. Bumpers 170 may be positioned in holes provided in end frame member 115 and subframe channel members 118 and 119 as seen in FIG. 12, but it will be understood that they may be placed in any of the frame members or elsewhere on the table.

Similarly, bumpers 171 may be provided as stops for the table in its usable position. As seen in FIGS. 11 and 12, bumpers 171 may be secured to the tops of vertical members 144 and 145 where they engage the underside of end frame member 116. Alternatively, the bumpers could be placed on member 116 to engage members 144 and 145, or the upper hinge arms 130*a* and 130*b*.

A nylon glide 172 may be positioned on the wall as seen best in FIG. 14, for engagement by the outer or lower side of end frame member 116 during the initial stage of movement of the table from its storage position, thereby protecting the wall from abrasion.

In this preferred embodiment, the geometry of the four bar linkage comprising upper hinge arm 130, lower hinge arm 120, the distance between pivots 122 and 132 on the table, and the distance between pivots 121 and 131 on the wall mounting assembly are carefully chosen according to the considerations set forth above with reference to FIGS. 8, 9 and 10. Specifically, offset distance 190 as shown in FIG. 14, is provided with respect to placement of pivots 122 and 132. Additionally, the length of lower hinge arm 120 is preferably selected to provide a preload as previously discussed. The effect of these factors is to provide the overcenter resistance force for holding the table in its vertical storage position.

In general, whole families or sets of different values for lengths are contemplated as previously set forth, and the particular example of a specific set of values for a preferred embodiment of the leg-type embodiment of the table has previously been set forth. For the preferred embodiment of the legless form of FIGS. 11–18, it has been found advantageous to pick a different set of values within the same principles, one that will maximize the distance between pivot points 131 and 121. This will allow lower hinge arm 120 to be placed at a more favorable angle with respect to the table in its usable position, as as to better support the load. Another difference from the preferred embodiment of FIGS. 1–10 is the use of a single lower hinge arm 120, rather than the pair of lower hinge arms 20*a* and 20*b* of the previous embodiment. In that embodiment, compressional forces for shortening the lower hinge arm are accommodated by outward bowing or bending of the lower hinge arms. As previously mentioned, other techniques can be used to accommodate the resilient compressional forces in the lower hinge arm during the overcenter movement.

The technique used in the preferred embodiment of FIGS. 11–18 is a resilient bending of pivot tube 127. As seen in FIG. 16, pivoting of lower hinge arm 120 with respect to the table is accommodated by pivot tube 127, bushings 126, and pivot bolt 124 which completes the pivotal connection to the subframe channel members. Pivot bolt 124 is secured by the subframe channel members with respect to any translational movement. However, pivot tube 127 is secured only at its ends, and its middle is spaced apart from pivot bolt 124. Accordingly, pivot tube 127 is free to flex or bow to accommodate the intentional mismatch in the length of lower hinge arm 120, during movement through the overcenter position. Resilient bending of pivot tube 127 holds the table securely against the wall in its vertical position as explained above.

One successful embodiment of the table of FIGS. 11–18 uses the following set of critical dimensions: The length of upper hinge arm 130 from pivot center to pivot center was 12½ inches. The corresponding length of lower hinge arm 120 was 23 11/16 inches. Table pivots 122 and 132 were 4¼ inches apart in a direction parallel to the table surface, and ¼ inch offset (dimension 190) in a direction perpendicular to the table top. With the table in its usable position, pivot 132 is approximately 15/16 of an inch higher than upper wall pivot 131. In this embodiment upper wall pivot 131 may extend outwardly from the wall approximately 3/16 of an inch further than lower wall pivot 121, although this dimension is not believed to be as critical as in the previous embodiment, so long as wall pivots 121 and 131 remain generally equally spaced outwardly from the wall.

From the preceding description it will be apparent that the present invention provides a folding wall table that is easy to fold and unfold, folds flat against a wall when not in use, and is held securely in its usable position by latches connected to the wall or wall mounting plate to provide a large and uncluttered work space.

We claim:

1. A folding wall table adapted for attachment to a wall for movement between a storage position vertically disposed adjacent the wall and a usable position horizontally extending from the wall, comprising:

a table surface member;

a wall mounting plate for attachment to a wall;

hinge means connecting said table surface member to said wall mounting plate for movement between said usable and storage positions so that the inner edge of the table, nearest the wall in the usable position, is the uppermost edge in the storage position; and first and second latch means connected respectively to said table surface member adjacent said inner edge thereof and to said wall mounting plate, said latch means for securing said inner edge of said table surface to said wall mounting plate when the table is in its usable position.

2. A folding table according to claim 1 wherein said first latch means includes a pair of latch bolt assemblies secured to the underside of the table surface member adjacent the inner edge.

3. A folding table according to claim 2 wherein said second latch means includes striker plates connected to said wall mounting plate and wherein said latch bolts engage said striker plates.

4. A folding table according to claim 1 further including latch release means positioned adjacent the outer end of the table and operatively connected to said first latch means for actuation thereof.

5. A folding wall table adapted for attachment to a wall for movement between a storage position vertically disposed adjacent the wall and a usable position horizontally extending from the wall, comprising:

a table surface member;

upper and lower hinge arm means;

upper and lower wall pivot means for pivotally connecting said upper and lower hinge arm means respectively to said wall with the pivot axis of said upper hinge arm means higher than the pivot axis of said lower hinge arm means;

upper and lower table pivot means for pivotally connecting said upper and lower hinge arm means respectively to the underside of said table surface member with the pivot axis of said upper table pivot means positioned closer to the wall, when the table is in its usable position, than the pivot axis of said lower table pivot means;

said hinge arm means and said pivot means for allowing movement of said table surface member between its usable and its storage positions with the underside of the table folding against the wall in the storage position;

the pivot axis of said lower table pivot means being spaced below a plane passing through the pivot axis of said upper table pivot means and parallel with the table surface when in its usable position, so as to provide an overcenter resistance force to the movement of the table through an intermediate position near the storage position; and latch means attached to the underside of said table surface member adjacent the edge thereof closest to the wall in the usable position, for securing said table in its usable position.

6. A folding wall table according to claim 5 wherein said wall pivot means includes a wall plate having striker plate means for cooperating with said latch means.

7. A folding wall table according to claim 6 further including latch release means positioned near the opposite end of the table surface member from the latch means, and means operatively connecting the release means for unlatching the table.

8. A folding wall table according to claim 5 wherein said upper hinge arm means comprises a pair of arms made of metal tubing.

9. A folding wall table according to claim 8 wherein said lower hinge arm means comprises a single relatively rigid arm, and wherein said lower table pivot includes a resilient tubular member pivoted to the table at its ends and connected to the end of the lower hinge arm at its center, whereby the resilient tubular member deflects to absorb the overcenter resistance force.

10. A folding wall table according to claim 8 wherein the effective length of said lower hinge arm is longer by a predetermined amount than the effective length of said upper hinge arm means plus the distance between said upper and lower wall pivot means minus the distance between said upper and lower table pivot means, so as to preload said resilient tubular member when the table is in its vertical storage position.

* * * * *